United States Patent [19]

Watanabe

[11] 4,218,670

[45] Aug. 19, 1980

[54] THERMOSTATIC CIRCUIT BREAKER

[75] Inventor: Tsukasa Watanabe, Toyota, Japan

[73] Assignee: Aisin Seiki Kabushiki Kaisha, Aichi, Japan

[21] Appl. No.: 950,823

[22] Filed: Oct. 12, 1978

[30] Foreign Application Priority Data

Oct. 31, 1977 [JP] Japan ..... 52-130403

[51] Int. Cl.[2] ..... H01H 37/52

[52] U.S. Cl. ..... 337/349; 337/367

[58] Field of Search ..... 337/343, 346, 348, 349, 337/354, 365, 367

[56] References Cited

U.S. PATENT DOCUMENTS

| | | | |
|---|---|---|---|
| 2,861,151 | 11/1958 | Moore | 337/343 |
| 3,322,920 | 5/1967 | Morris | 337/343 |
| 3,451,028 | 6/1969 | Schmitt | 337/343 |
| 3,500,277 | 3/1970 | Nardulli | 337/343 |
| 3,579,167 | 5/1971 | Grable | 337/354 X |
| 4,149,138 | 4/1979 | Pevzner et al. | 337/343 |

*Primary Examiner*—George Harris

*Attorney, Agent, or Firm*—Oblon, Fisher, Spivak, McClelland & Maier

[57] ABSTRACT

A thermostatic circuit breaker includes a movable contact which is movable in response to thermal transformation of a thermostatic disk. In order to easily support the movable contact, the movable contact is secured to an offset spring of electrically-conducting and elastic material and is located at a predetermined position with respect to the thermostatic disk and a stationary contact.

7 Claims, 4 Drawing Figures

THERMOSTATIC CIRCUIT BREAKER

BACKGROUND OF THE INVENTION

1. Field of the Invention

This invention relates to a thermostatic circuit breaker and more particularly to improvement in the thermostatic circuit breaker providing thermostatic disk sensitive to temperature.

2. Description of the Prior Art

A conventional thermostatic circuit breaker is disclosed for example in U.S. Pat. No. 3,579,167 granted on May 18, 1971 to Grable et al. According to such conventional type of circuit breaker, a movable contact is brought into contact with a stationary contact by stroke-amplifier means of a thermostatic disk, i.e., a "lever-ratio" device such as a transfer rod and a contact arm. Snap-over stroke of the temperature sensitive thermostatic disk is very short in distance, and therefore it is very difficult or impossible to move the movable contact directly by the thermostatic disk. When the movable contact is erroneously positioned, the expected operation thereof cannot be assured.

In addition, the positioning of the movable contact and the assembly thereof are difficult according to this conventional type circuit breaker.

SUMMARY OF THE INVENTION

One of the objects of this invention is to provide a thermostatic circuit breaker which will overcome the defects in conventional thermostatic circuit breakers.

Another object of this invention is to provide a thermostatic circuit breaker which will delete the stroke-amplifier means by using an off-set spring supporting the movable contact and by locating the same at a predetermined position.

Other objects will be in part apparent and in part pointed out hereinafter.

BRIEF DESCRIPTION OF THE DRAWINGS

Various other objects, features and attendant advantages of the present invention will be more fully appreciated as the same become better understood by reference to the following detailed description when considered in connection with the accompanying drawings wherein like reference characters designate like or corresponding parts throughout the several view, and wherein.

DETAILED DESCRIPTION OF THE PREFERRED EMBODIMENTS

Figure 1:
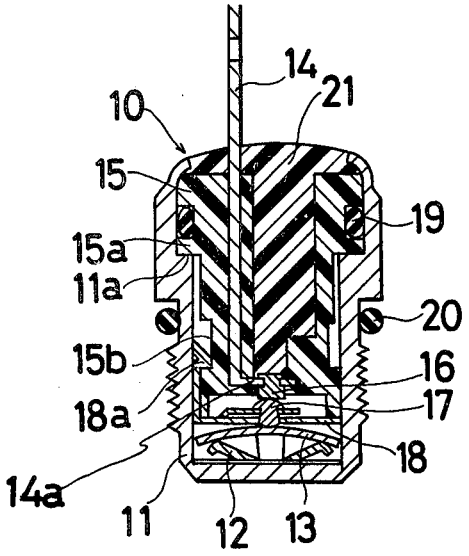
FIG. 1 is a cross-sectional view of one embodiment of a thermostatic circuit breaker according to the invention.

A thermostatic circuit breaker is generally indicated by reference numeral 10. The thermostatic circuit breaker 10 comprises a case 11 acting as the anchorage terminal which is made of suitable electrically-conductive and thermally-conductive material such as brass and is contacted with the surrounding medium in which variations of temperature take place.

A bimetalic disk 13 is clearly shown in FIG. 1 formed in such a way that its curvature reverses itself upon the predetermined temperature condition and is urged to move toward a movable contact 17 by a set spring 12. A stator 15 of insulating material has a cylindrical hole in which a plate 14 of electrically-conducting material is inserted for acting as the anchorage terminal. The stator 15 has a shoulder 15a on the outer peripheral surface thereof which is engageable with a step portion 11a on the inner peripheral surface of the case 11 and is installed at a predetermined position in the case 11 by engaging the shoulder 15a with step portion 11a.

Figure 2:
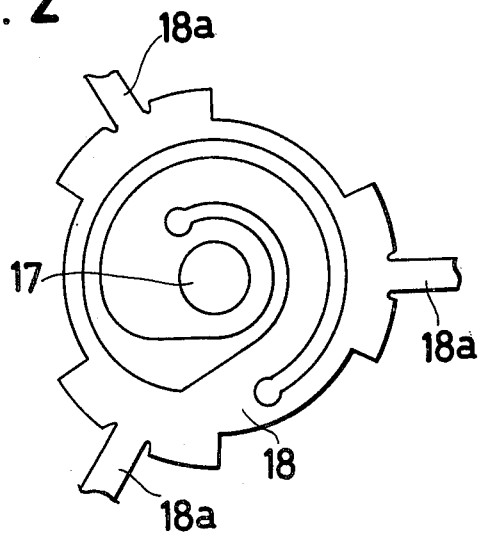
FIG. 2 is an enlarged plane view of an off-set spring partly broken away and used in the embodiment of FIG. 1.
Figure 3:
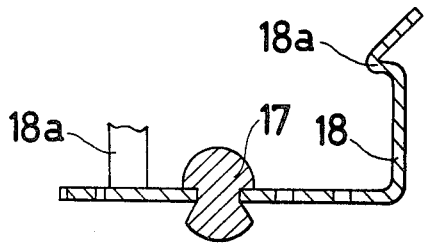
FIG. 3 is a side view of the off-set spring of FIG. 2.

A stationary contact 16 is secured to an inner and 14a of the plate 14. The movable contact 17 is adapted to move toward and away from the stationary contact 16 and is supported at the center portion of a off-set spring 18. The off-set spring 18 of electrically-conducting and elastic material is of swirl shape as clearly shown in FIG. 2. The movable contact 17 is urged to move away from the stationary contact 16 by the spring 18.

The stator 15 has a circular recess **15*b* on the outer peripheral surface thereof. The spring 18 has, for example, three legs 18*a* which are extended in the axial direction of the stator 15. The legs 18*a* are connected electrically to the inner surface of the case 15. The movable contact 17 is located at the predetermined position with respect to the bimetalic disk 13 and the stationary contact 16. Reference numerals 19 and 20** denote seals.

After the stator 15 is placed at the predetermined position in the case 11, the stator 15 is secured to the case 11 by calking the upper end of the case 11. Reference numeral 21 denotes a hermetic seal which is made of the synthetic resin for protecting the stationary contact 17 from the foreign materials. In the normal operation of the device, the case 11 is in contact with the surrounding medium. Through the case 11 the heat is transferred to the disk 13.

Figure 4:
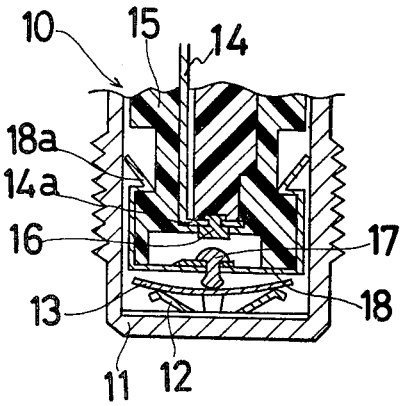
FIG. 4 is a partial cross section similar to FIG. 1 but showing the contacts in an open position.

Upon occurrence of the predetermined temperature condition, the disk 13 is in the form as shown in FIG. 1 thereby permitting the movable contact 17 to contact with the stationary contact 16 and form a closed circuit. At an increase of the temperature, the disk 13 is reversed to cause the snap-over action as shown in FIG. 4 thereby releasing the movable contact 17 from the stationary contact 16.

If the shape of the bimetalic disk 13 is formed vertically opposite to that of FIG. 1, the operation of the breaker is reversed from that of FIGS. 1-4.

In view of the above, it will be seen that the several objects of the invention are achieved, and other advantageous results attained. As many changes could be made in the above-noted constructions without departing from the scope of the invention, it is intended that all matter contained in the above description or shown in the accompanying drawings shall be interpreted as illustrative and not in a limiting sense. It is also intended that the appended claims shall cover all such equivalent variations as come within the true spirit and scope of the invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A thermostatic circuit breaker comprising:

a case acting as a first terminal which comprises electrically conducting material;

a temperature sensitive thermostatic disk installed in the case and movable from one curvature to an opposite curvature upon occurence of a perdetermined temperature condition;

a stator of electrically insulating material secured at a predetermined position in said case including a plate of electrically conducting material axially extending through said stator and acting as a second terminal;

a stationary contact secured to the inner end of said plate;

a movable contact movable toward and away from said stationary contact by said disk; and an off-set spring of electrically conducting and elastic material supported by said stator by the elasticity thereof and directly contacted with said case, said movable contact being securely mounted on said spring which is normally urged to move away from said stationary contact.

2. A thermostatic circuit breaker as set forth in claim 1, wherein said off-set spring is of swirl shape and has axially extending legs which are contacted with said case therethrough.

3. A thermostatic circuit breaker as set forth in claim 2, wherein said movable contact is secured to said off-set spring at substantially the center portion thereof.

4. A thermostatic circuit breaker as set forth in claim 1, wherein said stator has a circular recess on the outer peripheral surface thereof for supporting said off-set spring.

5. A thermostatic circuit breaker as set forth in claim 1, wherein said stator has a shoulder on the outer peripheral surface thereof, said case having a step portion on the inner peripheral surface thereof for engaging said shoulder.

6. A thermostatic circuit breaker comprising:

a case acting as a first terminal which comprises electrically conducting material;

a temperature sensitive thermostatic disk installed in the case and movable from one curvature to an opposite curvature upon occurrence of a predetermined temperature condition;

a stator of electrically insulating material secured at a predetermined position in said case including a plate of electrically conducting material axially extending through said stator and acting as a second terminal;

a stationary contact secured to the inner end of said plate a movable contact movable toward and away from said stationary contact by said disk; and an off-set spring of electrically conducting and elastic material supported by said stator by the elasticity thereof and directly contacted with said case, said movable contact being secured mounted on said spring which is normally urged to move towards said stationary contact.

7. A thermostatic circuit breaker as set forth in claim 1, said movable contact being directly movable towards said stationary contact by direct contact with said disk.

* * * * *